US008790164B2

(12) United States Patent
Rivard et al.

(10) Patent No.: US 8,790,164 B2
(45) Date of Patent: Jul. 29, 2014

(54) METHOD, SYSTEM, AND APPARATUS FOR MODIFYING SURFACES

(75) Inventors: Allen J. Rivard, White Bear Lake, MN (US); Galen A. Fitzel, St. Paul, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 13/277,247

(22) Filed: Oct. 20, 2011

(65) Prior Publication Data

US 2012/0034853 A1 Feb. 9, 2012

Related U.S. Application Data

(60) Division of application No. 12/685,205, filed on Jan. 11, 2010, now Pat. No. 8,052,506, which is a continuation of application No. 12/022,385, filed on Jan. 30, 2008, now Pat. No. 7,731,573.

(51) Int. Cl.

| | |
|---|---|
| ***B24B 23/00*** | (2006.01) |
| ***B24D 13/20*** | (2006.01) |
| ***B24D 9/00*** | (2006.01) |

(52) U.S. Cl.

CPC ..... *B24D 13/20* (2013.01); *B24D 9/003* (2013.01)

USPC ..... 451/490; 451/538

(58) Field of Classification Search

USPC ..... 451/494, 490, 538, 511, 523, 524

See application file for complete search history.

(56) References Cited

U.S. PATENT DOCUMENTS

| | | | | |
|---|---|---|---|---|
| 3,192,589 | A | | 7/1965 | Pearson |
| 3,346,904 | A | * | 10/1967 | Armstrong ..... 15/230.12 |
| 3,527,001 | A | | 6/1970 | Kleemeier et al. |
| 3,522,681 | A | * | 8/1970 | Lampert ..... 451/490 |
| 3,703,739 | A | * | 11/1972 | Young et al. ..... 15/230.17 |
| 4,875,259 | A | | 10/1989 | Appeldorn |
| 5,097,570 | A | | 3/1992 | Gershenson |
| 5,439,413 | A | | 8/1995 | Lägler |
| 5,505,747 | A | | 4/1996 | Chesley et al. |
| 5,667,540 | A | | 9/1997 | Chesley et al. |
| 5,672,186 | A | | 9/1997 | Chesley et al. |
| 5,683,143 | A | | 11/1997 | Peterson et al. |
| 5,785,784 | A | | 7/1998 | Chesley et al. |
| 5,807,161 | A | * | 9/1998 | Manor et al. ..... 451/442 |
| 5,840,089 | A | | 11/1998 | Chesley et al. |
| 6,021,771 | A | | 2/2000 | Swan et al. |

(Continued)

FOREIGN PATENT DOCUMENTS

| | | |
|---|---|---|
| JP | 07-050141 | 11/1995 |
| JP | 08-309653 | 12/1996 |
| KR | 10-2002-0022047 | 3/2002 |

OTHER PUBLICATIONS

Instructions for Use Insta-Lok® Driving Assembly from Building Service & Cleaning Products Division / 3M Corporation, St. Paul, MN.

(Continued)

*Primary Examiner* — Robert Rose

(74) *Attorney, Agent, or Firm* — David B. Patchett

(57) ABSTRACT

The present disclosure is directed to method, apparatus, and system for uniformly supporting flexible surface modifying articles during surface modification as well as enabling replacing and repositioning thereof for improving their useful service life as well as improving dust and debris control management.

13 Claims, 3 Drawing Sheets

(56) References Cited

U.S. PATENT DOCUMENTS

| | | | | |
|---|---|---|---|---|
| 6,197,076 | B1 | 3/2001 | Braunschweig et al. | |
| 6,210,389 | B1 | 4/2001 | Long et al. | |
| 6,227,959 | B1 * | 5/2001 | Beaudry | 451/526 |
| 6,234,886 | B1 | 5/2001 | Rivard et al. | |
| 6,394,887 | B1 * | 5/2002 | Edinger | 451/494 |
| 6,517,423 | B2 * | 2/2003 | Ueno | 451/359 |
| 6,579,161 | B1 | 6/2003 | Chesley et al. | |
| 6,579,162 | B2 | 6/2003 | Chesley et al. | |
| 6,638,151 | B2 | 10/2003 | Ueno | |
| 6,752,707 | B1 | 6/2004 | Palushi | |
| 7,104,739 | B2 | 9/2006 | Lagler | |
| 7,140,957 | B2 | 11/2006 | Thysell et al. | |
| 2005/0227599 | A1 | 10/2005 | Fisher | |
| 2005/0227600 | A1 | 10/2005 | Fisher | |

OTHER PUBLICATIONS

Sales Material from CENO Group, Houston, TX.

* cited by examiner

METHOD, SYSTEM, AND APPARATUS FOR MODIFYING SURFACES

CROSS-REFERENCE TO RELATED APPLICATION

This application is a divisional of U.S. application Ser. No. 12/685,205, filed Jan. 11, 2010, now U.S. Pat. No. 8,052,506 which is a continuation of U.S. application Ser. No. 12/022,385, filed Jan. 30, 2008, now issued as U.S. Pat. No. 7,731,573, the entire disclosure of which is incorporated by reference herein.

BACKGROUND

The present disclosure is directed to a method, system, and apparatus for modifying or conditioning a working surface. More particularly, it is directed to a method, apparatus, and system for uniformly supporting flexible surface modifying articles as well as enabling replacing and repositioning thereof for improving useful service life as well as improving dust and debris control management.

A variety of attachment systems have been employed to attach an abrasive article, such as an abrasive sheet or disc, to a power abrading tool, such as a sanding tool, whereby the former is driven by the latter. Abrasive sheets and discs have relatively flexible constructions and are available in a wide variety of sizes and shapes. Typically, the abrasive particles are on one major surface of a sheet or disc article. These kinds of abrasive sheets are normally held in place on the abrading tool by mechanical center bolt and washer and the like that require relatively considerable user manipulations to attach and detach for each abrasive disc used.

Another known system for securing abrasive articles to a power tool includes the use of releasable types of attachment mechanisms. Releasable attachment mechanisms allow the abrasive article to be manually applied and peeled from the power tool. In practice, one component of these releasable attachment mechanisms is located on a major surface of the abrasive article that opposes the abrasive covered or work surface. The other component of the releasable attachment mechanism may be located on a back-up pad secured to the power tool.

Numerous kinds of releasable attachment mechanisms exist. One kind includes pressure sensitive adhesives. Another kind includes the use of mechanical hook and loop fastener systems. Since not all hook and loop type fasteners are necessarily compatible for attachment to the back-up pad, their versatility may be somewhat limited. For example, abrasive articles having a loop fabric with a specific configuration may not be attached to a back-up pad having a non-compatible attachment structure. Accordingly, to use a greater number of surface modifying articles, the back-up pad has to be removed. Given that in most sanding operations, a user may change the abrasive articles several times, the foregoing attachment and detachment approaches present rather time-consuming and labor intensive approaches. While these latter types are generally satisfactory they may be considered to be a somewhat more time-consuming and laborious process than otherwise desired in the workplace. Accordingly, versatility of this kind of attachment system may be somewhat limited.

Attempts to increase versatility of attachment systems using flexible abrasive disks including hook and loop fasteners thereon have included providing reversible back-up pads. The reversible back-up pads use two different types of attachment surfaces; one on each of the opposing major surfaces so as to increase versatility with a wider number of abrasive articles. While versatility increases nevertheless, even these approaches require the back-up pads to be manually attached and detached from a power tool in order to enhance versatility of the usable surfaces.

Conversion pads are another type of attachment mechanism useful for providing additional versatility because they increase the number or kinds of abrasive discs that can be quickly assembled to the back-up pad without requiring the latter to be removed from the power tool. One known conversion pad includes two opposing major surfaces, each with a different kind of attachment mechanism. One may be engageable with the back-up pad, and the other may releasably engage with hook and loop fasteners of an abrasive article. Another known type of conversion pad has a non-woven and flexible construction. One major surface thereof may directly engage back-up pads having different coupling configurations, and the other directly engages any one of a variety of hook and loop configurations on the flexible abrasive articles.

While several of the foregoing surface modifying articles provide versatility and operate satisfactorily, nevertheless, none provides methods, apparatus, or systems for providing versatility and yet overcomes the formation of surface irregularities or blemishes, such as when abraded surfaces have areas of different hardness. For example, when sanding wood surfaces, the abrasive articles mounted on back-up pads or flexible conversion pads, such as of the non-woven kind may result in a dishing effect being created between the softwood (spring wood) grains and the hardwood (summer wood) grains. Dishing is generally considered a sculpting out of the softwood grain, relative to the hardwood grain, by the sander during sanding. It is essentially caused by the disparity of hardness between the softwood relative to the hardwood, thereby resulting in the sander causing an uneven or pitted surface when the abrading disc abrades into the softwood and grabs the same. Dishing is generally considered an undesirable blemish in the surface appearance of wood following sanding.

Furthermore, replacement and repositioning of such abrasive articles from the above types of abrasive article attaching systems may be tedious and at times be relatively difficult to perform. For example, when an operator attempts to peel the flexible abrasive discs from flexible conversion pads, the mating abrasive surfaces mesh more aggressively with each other into a tighter engagement. As a result, detaching the abrasive articles may be made more difficult. Accordingly, aggressive meshing makes replacement and repositioning of the abrasive articles relatively more difficult to achieve.

Moreover, there is a continuing desire to enhance the useful service life of abrasive discs as well as minimize the deleterious effects of powdery particles and other similar debris formed during surface modifying operations since such powdery particles and debris may build-up on the work surface of the disk and limit the abrading effectiveness of the abrasive particles.

SUMMARY

Accordingly, needs exist for improved methods, systems, and articles for use in coupling a surface modifying article to a driving assembly of a power tool without having to replace elements of the driving assembly and to provide support for the surface modifying article while the latter is modifying a surface particularly those surfaces having different hardness sections by maintaining a surface modifying plane. These needs further include being able to enhance useful service life and easily replace and reposition the surface modifying articles in a manner that also extends their useful service life while minimizing the deleterious effects of powdery particles and debris formed by surface modifying operations.

The present description provides an apparatus adapted to carry a flexible surface modifying article while modifying a working surface. The apparatus comprises: an adapter body including at least one major surface adapted to be releasably attached to a surface of a flexible surface modifying article; the adapter body includes at least one stiffening portion that resists deformation of the surface modifying article when the stiffening portion directly supports the surface modifying article for modifying a working surface so that the flexible surface modifying article substantially remains in a surface modifying plane while modifying the surface.

The present description provides a method of modifying a working surface. The method comprises: providing an adapter body including at least one major surface adapted to be releasably attached to a flexible surface modifying article; providing the adapter body with at least one stiffening portion that resists deformation of the flexible surface modifying article so that the surface modifying article substantially remains in a surface modifying plane while modifying the working surface; attaching the surface modifying article to the stiffening portion; and imparting movement to the adapter body such that the stiffening portion directly supports the surface modifying article to remain in a surface modifying plane while modifying the surface.

The present description provides a system for use in modifying a surface. The system comprises: a power tool; a driving assembly coupled to the power tool; the driving assembly including a driving member having a major surface and an attachment mechanism for attachment to a conversion pad; a conversion pad having first and second opposing major surfaces, at least one of the first and second major surfaces of the conversion pad has an attachment mechanism attachable to the attachment mechanism of the driving member; a flexible surface modifying article having first and second major surfaces, wherein at least one of the major surfaces is attachable to the conversion pad; and an adapter body including opposing first and second major surfaces, wherein at least one is adapted to be releasably attached to the surface modifying article and the other is adapted to be releasably attached to the conversion pad; the adapter body including at least one stiffening portion that resists deformation of a surface modifying article when the stiffening portion directly supports the surface modifying article for modifying a working surface so that the surface modifying article substantially remains in a surface modifying plane while modifying the surface.

The present description provides a method of modifying a wood surface having hardwood and softwood areas. The method comprises: providing an adapter body having at least one major surface; providing a first attachment mechanism on the first major surface for releasable attachment to at least a flexible surface modifying article; providing a second attachment mechanism on the second major surface for releasable attachment to a driving member; providing the adapter body with at least one stiffening portion that resists deformation of the surface modifying article so that the surface modifying article substantially remains in a surface modifying plane while modifying the surface; attaching the modifying article to the stiffening portion; and imparting movement to the adapter body so that the surface modifying article engages the wood surface, whereby the stiffening portion provides a surface modifying plane for the surface modifying article that bridges softwood and hardwood areas.

The present description provides a method of enabling at least one flexible abrasive element having a releasable attaching mechanism on one major surface thereof to be attached to and detached from a surface modifying tool having a driving member for imparting movement of the abrasive element. The method comprises: providing an adapter body having at least one major surface; providing an adapter body including one or more spaced apart stiffening portions that resist deformation of the flexible surface modifying article so that the surface modifying article substantially remains in a surface modifying plane while modifying a working surface; providing one or more of the spaced apart attachment mechanisms on one or more of the stiffening portions; attaching a surface modifying article to cover the attachment mechanisms, and imparting movement to the adapter body, whereby each of the one or more of the stiffening portions directly supports each of its corresponding one or more spaced apart attachment mechanisms.

The present description includes an apparatus that comprises an adapter body having at least one major surface; and an attachment mechanism on the one major surface for releasable meshing engagement to a matable attaching mechanism of a flexible surface modifying article; the adapter body has a relatively stiff construction such that when the mating attaching mechanism of the flexible surface modifying article is peeled from meshing engagement from the mating attachment mechanism tighter meshing engagement therebetween is inhibited because the adapter body resists bending.

The present description includes a method that facilitates peeling of a surface modifying article having a releasable mechanical attachment mechanism on an adapter body that acts as an attachment interface between the surface modifying article and a driving assembly of a power tool. The method comprises: providing an adapter body that is an interface between the surface modifying article and a driving assembly of a power tool, wherein the adapter body has opposing first and second major surfaces; providing an attachment mechanism on one of the first and second major surfaces for releasable attachment to the attaching mechanism of the flexible surface modifying article; providing the adapter body with a substantially stiff construction such that during peeling separation of the flexible surface modifying article from engagement with the attachment mechanism from tighter engagement therewith is inhibited because the adapter body resists bending.

The present description provides a system for use in modifying a surface. The system comprises: a power tool; a driving assembly coupled to the power tool; the driving assembly including a driving member having a major surface and an attachment mechanism for attachment to a conversion pad; a conversion pad having first and second opposing major surfaces, at least one of the first and second major surfaces of the conversion pad has an attachment mechanism attachable to the attachment mechanism of the driving member; a flexible surface modifying article having first and second major surfaces, wherein at least one of the major surfaces is attachable to the conversion pad; and an adapter body including opposing first and second major surfaces, wherein at least one is adapted to be releasably attached to the surface modifying article and the other is adapted to be releasably attached to the conversion pad; the adapter body including at least one stiffening portion that resists deformation of a surface modifying article when the stiffening portion directly supports the surface modifying article for modifying a working surface so that the surface modifying article substantially remains in a surface modifying plane while modifying the surface, and the stiffening portion is sufficiently stiff such that the flexible surface modifying article, when peeled therefrom inhibits even tighter engagement therewith.

The present description provides a method of controlling displacement of powdery particles and debris resulting from the modification of a working surface by a surface modifying article. The method comprises: providing a driving member having a driving surface that is rotatable about an axis; providing a plurality of spaced apart attaching elements on the driving surface at least adjacent its periphery and each having an orientation relative to the axis; providing a continuous surface modifying article covering the plurality of peripheral attaching elements and spaced from the driving surface to define a peripheral gap for controlling movement of the powdery particles and debris generally radially from the axis; and imparting movement to the driving member relative to the axis such that the direction of movement and the orientation of the spaced apart elements controls displacement of the powdery particles and debris formed by the surface modifying article.

The present description provides an apparatus for controlling displacement of powdery particles and debris resulting from the modification of a working surface by a surface modifying article. The apparatus comprises: a driving member having a driving surface rotatable about an axis of rotation; a plurality of spaced apart elements on the driving surface at least adjacent its periphery, a continuous surface modifying article covering the plurality of elements and spaced from the driving surface to define a peripheral gap for controlling movement of powdery particles and debris generally radially from the axis of rotation; and the elements are spaced relative to each other and have an orientation relative to the axis of rotation such that in response to rotation being imparted to the driving member displacement of the powdery particles and debris formed by the surface modifying article are radially dispersed.

The present description provides a system of controlling displacement of powdery particles and debris resulting from the modification of a working surface by a surface modifying article. The system comprises: a driving member having a driving surface that is rotatable about an axis; a plurality of spaced apart attachment elements on the driving surface at least adjacent its periphery and each having an orientation relative to the axis of rotation; a continuous surface modifying article covering the plurality of elements and spaced from the driving surface to define at least one peripheral gap for controlling displacement of the powdery particles and debris generally radially from the axis of rotation, such that the orientation of the spaced apart elements and the imparting of rotation controls displacement of the powdery particles and debris, formed by the surface modifying article, relative to the gap.

The present description provides a method of extending the lifetime of use of a surface modifying article. The method comprises: providing a driving member that has a driving surface and is rotatable about an axis of rotation; providing a plurality of spaced apart segments on the driving surface adjacent to at least its periphery; attaching a surface modifying article to engage and cover the spaced apart segments, whereby each of the segments provides an area of greater per unit pressure on corresponding portions of the working surface during surface modification by the surface modifying article, imparting movement of the surface modifying article relative to the rotational axis, whereby those corresponding portions of the surface modifying article provide greater wear than portions not in engagement with the segments which have less relative wear.

The present description provides an apparatus of extending the lifetime of use of a surface modifying article. The apparatus comprises: a driving member having a driving surface rotatable about an axis; a plurality of spaced apart segments formed on the driving surface adjacent to at least its periphery for supporting a surface modifying article; and a surface modifying article having first and second opposing major surfaces, wherein the first major surface has at least one portion in releasable engagement with the segments and the second major surface is adapted to modify a working surface; the segments form areas of greater unit pressure on corresponding portions of the second major surface during surface modification by the surface modifying article than portions of the first major surface not in engagement with the segments, such that the releasable engagement enables those portions initially not in engagement to be subsequently placed in engagement with the segments.

The present description provides a system of extending the lifetime of use of a surface modifying article. The system comprises: a power tool for driving an apparatus and an apparatus of extending the lifetime of use of a surface modifying article, the apparatus of the system includes a driving member having a driving surface rotatable about an axis; a plurality of spaced apart segments formed on the driving surface adjacent to at least its periphery for supporting a surface modifying article; and a surface modifying article having first and second opposing major surfaces, wherein the first surface is in releasable engagement with the segments and the second surface is adapted to modify a working surface; the segments form areas of greater unit pressure on corresponding portions of the second surface during surface modification by the surface modifying article than portions of the first surface not in engagement with the segments, such that the releasable engagement enables those portions initially not in engagement to be placed in engagement with the segments.

An aspect of the present description includes method, system, and apparatus using an adapter for releasable attachment to a driving member for supporting a flexible surface modifying article in a surface modifying plane so as to resist deformation thereof while the latter is in working engagement with a working surface.

An aspect of the present description includes method, system, and apparatus using an adapter for quickly attaching and detaching a flexible surface modifying article to and from a driving member for supporting the latter in a surface modifying plane so as to resist deformation thereof while in working engagement with a wood surface having softwood and hardwood sections, so that dishing is substantially reduced or eliminated.

Another aspect of the present description includes method, system, and apparatus that achieve the foregoing and allows additional kinds of surface modifying articles to be attached to back-up and conversion pads.

Another aspect of the present description includes method, system, and apparatus that achieve the foregoing and provide a stiff adapter that facilitates easy peeling or delaminating of such flexible articles therefrom.

Another aspect of the present description includes method, system, and apparatus that achieve the foregoing in a highly versatile, economical, and reliable manner.

Another aspect of the present description includes method, system, and apparatus that achieve the foregoing and increase the useful service life of surface modifying articles.

Still another aspect of the present description includes method, system, and apparatus that achieve the foregoing by establishing spaced apart segments on the adapter that provide greater unit pressure on corresponding working portions of the flexible surface modifying articles than their surrounding adjacent segments, whereby the surface modification is performed primarily by the working portions subject to the greater unit pressure.

Yet another aspect of the present description includes method, system, and apparatus, wherein the surface modifying article is repositionable relative to the adapter, such that those portions previously not subject to the greater unit pressure are repositionable over the segments and thus are subjectable to the greater unit pressure, whereby useful service life is enhanced.

Yet still another aspect of the present description includes method, system, and apparatus, wherein useful service life of a surface modifying article is enhanced by controlling movement of powdery particles and debris.

The aspects described herein are merely a few of the several that may be achieved by using the present description.

The foregoing descriptions thereof do not suggest that the present disclosure must only be utilized in a specific manner to attain the foregoing aspects.

These and other features and aspects of the present description will be more fully understood from the following detailed description of exemplary embodiments.

DETAILED DESCRIPTION

The words "a", "an", and "the" are used interchangeably to mean one or more of the elements being described. By using words of orientation, such as "top", "bottom", and "backing" and the like for location of the various elements in the disclosed articles, we refer to the relative position of an element with respect to a horizontally-disposed body portion. It is not intended that the disclosed articles should have any particular orientation in space during or after their manufacture.

Figure 1:
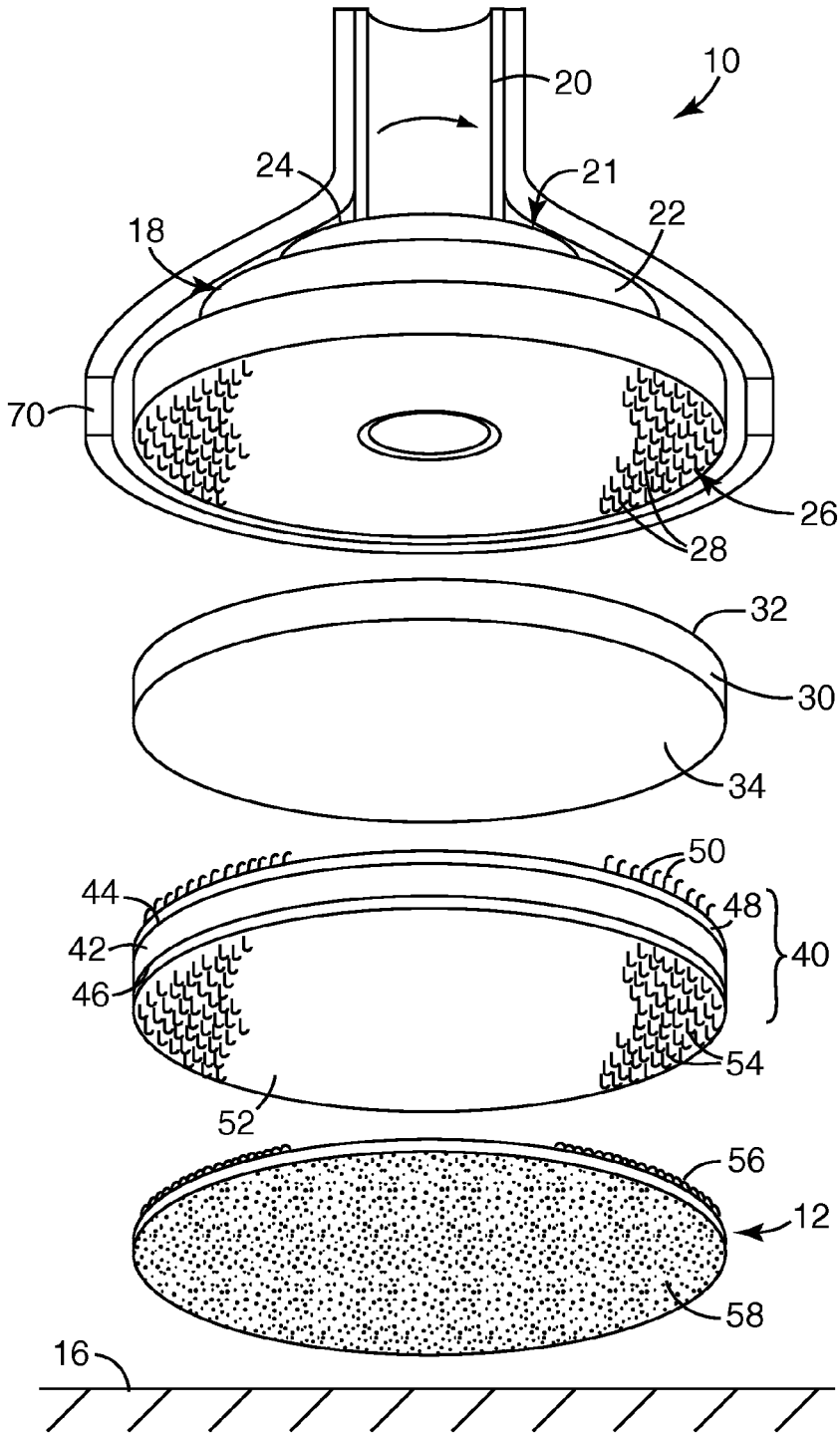
FIG. 1 is an exploded perspective schematic view of an adapter apparatus of the present description for use in an attachment system that secures an abrasive article to a power tool driving assembly.
Figure 2:
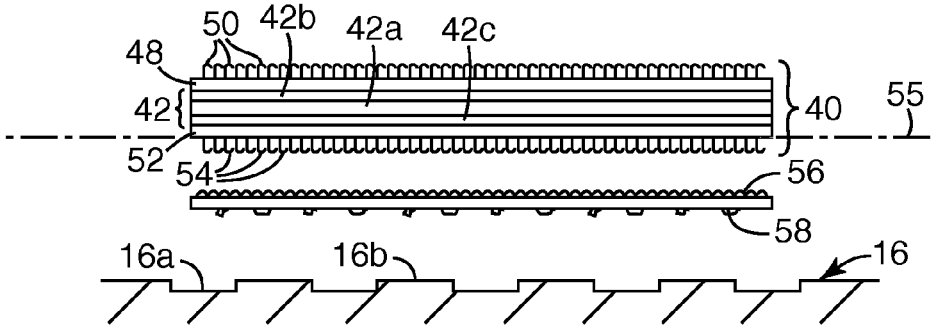
FIG. 2 is a partial exploded schematic view of the adapter apparatus of FIG. 1 along with an abrasive article in relationship to a wood surface.

Reference is made to FIG. 1 for illustrating one exemplary embodiment of the present disclosure, wherein there is envisioned use of an abrading power tool 10, such as a floor sanding machine 10 for rotating a surface modifying article 12, such as an abrasive article 12, for treating or modifying a working surface 16, such as wood flooring surface 16 or the like. The wood flooring surface 16 may include hardwood sections 16*b* and softwood sections 16*a* (FIG. 2). While wood flooring is described as a surface being modified, it will be appreciated that other surfaces may be conditioned or modified by an appropriate surface modifying article and that surface modifying includes, but is not limited to grinding, blending, polishing, cleaning, or debarring surfaces. While a rotary type sanding machine is described, it will be appreciated other surface modifying type devices may be used, such as orbital sanders, random orbital sanders, dual action sanders, vibratory sanders, corner sanders, buffers, polishing devices, and the like. The present description is not limited by the type of rotatable driving device or power tool to be used since even manual abrading may be enhanced by the present description.

The floor sanding machine 10 of the present exemplary embodiment uses any suitable source of motive power for rotating a driving assembly 18 to which the abrasive articles are removably attached. For driving the driving assembly 18, the floor sanding machine 10 includes a rotary drive shaft assembly 20. The rotational speeds provided by the drive shaft assembly 20 may vary depending on the kinds of surface treatment to be accomplished by the abrasive article 12.

In the exemplary embodiment, the driving assembly 18 includes a housing 21 having an annular riser portion 22 attachable to a clutch or attachment plate 24 which are, in turn, attached, in a known manner, to the rotary drive shaft assembly 20. The driving assembly 18 may be an INSTA-LOKT™ driving assembly commercially available from 3M Company, St. Paul, Minn. Included in the driving assembly 18 may be an annular shaped back-up pad 26. The back-up pad 26 may be of any type and in this embodiment includes a plurality of randomly spaced apart fastening elements 28, such as bristles 28, or the like, covering its surface. The fastening elements 28 are adapted to drivingly engage a conversion pad assembly 30 in a manner to be described. While the bristles 28 are one form of fastening element that may be used for coupling to a conversion pad, other suitable forms of releasable attachment elements may be used. For example, the present description envisions all kinds of releasable attachment mechanisms, including, but not limited to, a wide variety of hook and loop fastening elements or mechanisms or the like. Some fastening elements include solid protrusions including a stem and an expanded region or head that may take a variety of shapes. Exemplary patents describing this latter type of a fastener include: U.S. Pat. Nos. 3,192,589; and 5,097,570. Another type of fastening element includes a multiplicity of intermeshing solid protrusions are described in U.S. Pat. No. 4,875,259. An example of a suitable hook and loop mechanism is commercially available from 3M Company, St. Paul, Minn. under the trade designations 3M Hookit™ and Hookit™ II. Other suitable configurations of hook and loop attachments are within the scope of the present disclosure. Also, any suitable adhesive system including any kind of pressure-sensitive adhesive may be used instead of the hook and loop arrangements.

Reference is now made to FIG. 1 in conjunction with FIG. 2 for illustrating a conversion pad 30 usable in the present exemplary embodiment. A wide variety of suitable conversion pads may be used for attaching abrasive articles to the driving back-up pad without having to change the back-up pad or mechanically remove an abrasive article from the back-up pad by using tools.

In the present embodiment, the conversion pad 30 has first and second opposed major surfaces 32 and 34, respectively. The first and second opposed major surfaces 32, 34 are generally circularly shaped and have a size and shape that may match that of the back-up pad as well as a the shape and size of one of the abrasive articles 12. In addition, the conversion pad 30 in the exemplary embodiment may be a non-woven material adapted to engage the fastening elements 28 of the back-up pad 26 in such a manner that the latter may be driven by the former. The material of the non-woven pads and their thicknesses may vary depending on a number of factors, such as the type and size of fastening elements they are to cooperate with and the rotation speeds and forces to be encountered.

In general, thicker pads are useful with larger mechanical fastening elements and higher rotational forces. For example, the non-woven materials may include but are not limited to polyester, nylon, polyurethane, or the like. Whatever materials are used for the non-woven material of the conversion pad they should be suitable for effectuating the kind of driving action intended to be delivered to the abrasive article. These kinds of non-woven conversion pads may be similar to the cleaning pads that are commercially available from 3M Company, St. Paul, Minn. One such example may be a 3M™ Scotch Brite™ driving pad that may be particularly used in wood sanding conditions. This pad may have an appropriate thickness to accomplish the kinds of surface modification contemplated. It will be appreciated that the present description envisions the use of conversion pads having different constructions than those with non-woven constructions. For example, the conversion pad may have a construction, such as described in commonly assigned United States Patent Application, 2005/0227600 A1 which description is incorporated herein by reference and made apart hereof. As described therein the conversion pad has a first major surface that has a releasable attachment mechanism adapted for engagement with the back-up pad, and a second major surface that has a releasable attachment mechanism for attaching the conversion pad to an adapter apparatus 40 to be described.

Continued reference may be made to FIGS. 1 and 2 for illustrating an exemplary embodiment an adapter apparatus 40 made according to one exemplary embodiment of the present disclosure. The adapter apparatus 40 may include at least one generally planar stiffening portion or assembly 42 having first and second major surfaces 44 and 46. A first attachment mechanism 48 may be provided on the first major surface 44 and has releasable fastening elements 50 that are adapted to drivingly engage a complementary kind of attachment mechanism of the conversion pad. A second attachment mechanism 52 may be provided on the second major surface 46 and has releasable fastening elements 54 that are adapted to engage complementary releasable attachment elements of the abrasive article 12.

The stiffening assembly 42 may be made from a variety of materials and constructions that substantially resist against deformation or bending of a flexible abrasive article 12 carried thereby as the latter is under loading while it performs a working or surface modifying operation on wood flooring or the like. Accordingly, the surface modifying abrasive article substantially remains in a surface modifying or abrading plane 55 (FIG. 2) while performing such work or surface modifying operations. In this manner, the abrasive article will be uniformly supported in a plane to perform a uniform sanding operation which avoids, for example, the dishing as the abrasive article bridges, by extending over, sections of differing hardness, such as hardwood and softwood areas of flooring. In addition, the stiffening assembly tends to keep edges of surfaces, such as, bowling alley lanes, being treated generally flat.

In the present exemplary embodiment, the construction of the stiffening assembly 42 comprises: a generally planar laminate including a plurality of layers that are joined together in an integral manner. The stiffening assembly 42 may include a core 42*a* that is sandwiched by and between a pair of spaced apart planar members 42*b, c* that have a hard and smooth exterior surface. The core 42*a* material may include a stiff and generally planar member that may be made of a variety of materials that include, but are not limited to, plastics, tempered hardwood, fiberglass products, plywood or the like. The planar members 42*b, c* may be suitably joined to planar surfaces 44, 46 of the core 42*a* by any known and suitable approach, such as adhesives. The exterior surfaces of the planar members 42*b,c* provide a relatively smooth support for the respective first and second attachment mechanisms 48 and 50; respectively. The thicknesses of the respective layers of the planar laminate may be increased or decreased to provide the degree of stiffness desired for the surface modifying actions to be performed. Also, mechanical properties, such as the modulus of elasticity of the layers, may be selected to also provide the degree of stiffness desired. In one exemplary embodiment, the stiffening assembly core 42*a* may be made of a suitable tempered hardwood, or a plywood material, plastic or other equivalent material, and the planar members 42*b, c* may made of a smooth and planar melamine material. Such kinds of melamine coated particle boards may be commercially available from a variety of sources. While the stiffening assembly 42 may be described as a composite laminate construction, it will be appreciated that it may be made of a one-piece construction made of any suitable materials. In addition, its size and configuration may be selected to match the condition surface conditioning article it is to be used with.

Reference is now made to the first and second attachment mechanisms 48 and 52, respectively. The first and second attachment mechanisms 48 and 52 may include respective ones of the hook or loop fastening elements, a pressure sensitive adhesive, or any other known releasable attachment mechanism. In the exemplary embodiment, the first attachment mechanism 48 may include a plurality of hook elements 50 and the second attachment mechanism 52 may include a plurality of loop elements 54. Alternatively, a plurality of hook elements may be used. It will be understood that the attachment elements may be selected so as to be compatible to the attachment mechanism 56 located on a major surface of the flexible abrading article 12.

The flexible abrasive articles 12 have abrasive particles 58 for performing the abrading. While the abrasive particles are used, the present description includes other kinds of surface treating articles, such as but not limited to grinding, blending, polishing, cleaning, or deburring surfaces. Alternatively, the abrasive article may have a donut type shape. As noted, known abrasive articles have releasable attachment mechanisms that include hooks and loop systems, and such may be commercially available from the 3M Company, St. Paul, Minn., under the designation "HOOKIT™" and "HOOKIT II™". A wide variety of suitable abrasive articles may be provided.

An alternative exemplary embodiment envisions a stiffening adapter assembly having a surface attachable to at least one pressure sensitive adhesive on the surface modifying article itself. Its opposing major surface has a surface that may be enlargeable with a pressure sensitive adhesive of the surface modifying article. The stiffening assembly would be constructed to resist deformation of the surface modifying article while carrying the surface modifying article during surface modifying.

Figure 3:
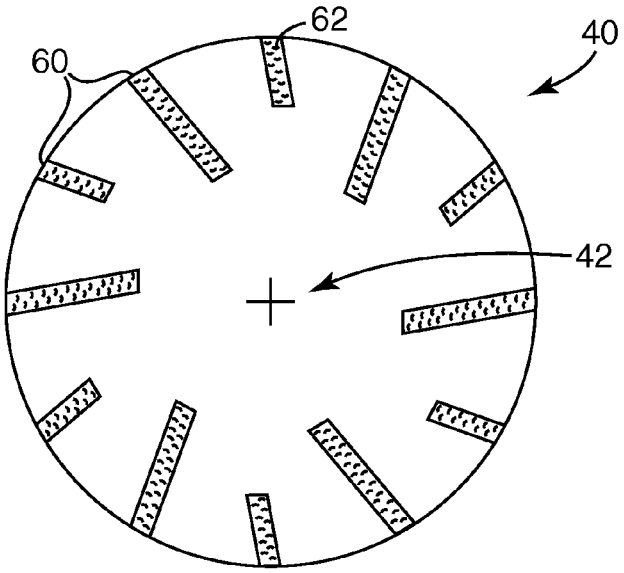
FIG. 3 is a planar schematic view of another exemplary embodiment of an adapter apparatus of the present description.

As viewed in FIG. 3, provision is made for another exemplary embodiment. A plurality of attaching elements 60 is attached to selected portions of the stiffening assembly 42 in spaced apart relationship to each other. Advantageously, this embodiment differs from the foregoing in that the entire surface of the adapter apparatus 40 need not be covered by an attachment mechanism. The adapter apparatus 40 will still provide for the uniform support of the abrading article in an abrading or surface modifying plane while sanding, but only for those of the portions of the surface modifying article in engagement therewith. It will be understood that those portions of the abrading article 12 not engaged with the attaching segments 60, elements 60 adapter apparatus will not abrade or otherwise condition the wood surface as much as those in engagement. In some circumstances little abrasion will occur.

Figure 5:
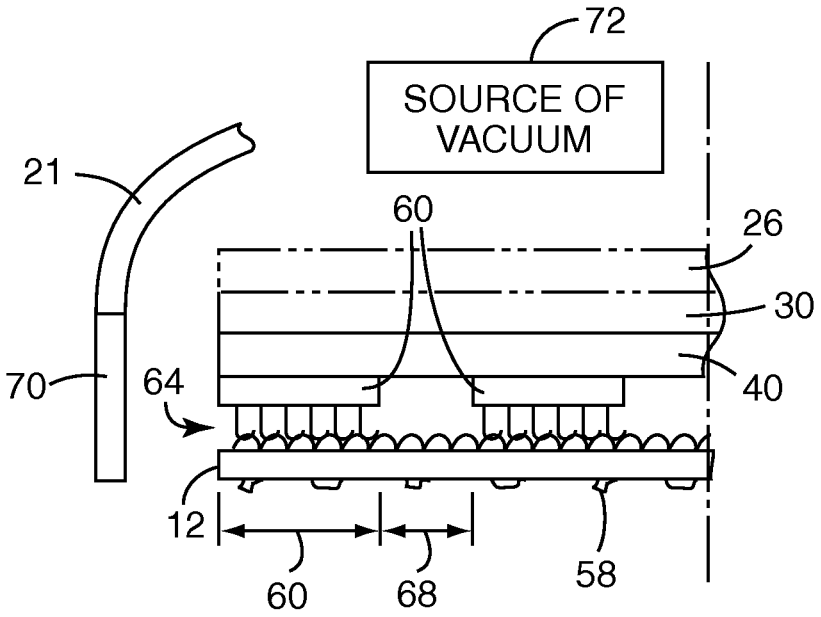
FIG. 5 is an enlarged schematic view similar to FIG. 1, illustrating a peripheral gap between the surface modifying article and an adapter made according to the present disclosure.

In FIG. 5, a peripheral gap or space 64 exists between the abrasive article 12 and the adapter apparatus 40 through the attaching elements 60. The resulting gap 64 will serve to provide radial paths for the powdery particles and debris to migrate radially outwardly while the surface modifying article rotates as will be explained. Also, because of the releasable elements 60, the abrasive article 12 may be repositioned or indexed so that unworn or lesser worn portions of the article may be positioned over and supported by the plurality of attaching elements 60, thereby allowing surface modifying in subsequent operations by the lesser or unused portions. As such, this also prolongs the use of the abrasive articles.

In the exemplary embodiment, each of the attaching elements 60 may be defined by a generally elongated rectangular shape. The attaching elements 60 are mounted so that their longitudinal axes (not shown) are in a generally radially offset relationship to the rotational axis and they are circumferentially spaced apart from each other. Alternate long and short attaching elements 60 allow for more complete use of the outside of the disc if strips are of same width. Alternatively, the attaching elements 60 may have straight radial positioning that will also propel dust to the edge due to centrifugal force, and will also work with machines rotating in the opposite direction.

The present disclosure envisions that a wide variety of geometrically different sizes and shapes may be used as well as a wide degree of angular orientations relative to the axis. The attachment elements 60 may take spiral shapes or the like. The attaching elements 60, because they are supported by corresponding segments of the stiffening assembly of the adapter apparatus 40, resist deformation and thus provide for more unit pressure on corresponding portions 60 of the working surface of the abrasive article 12 than those portions 68 not supported by the stiffening assembly. Thus, when the abrasive article 12 is applied to the working surface, those portions 68 (FIG. 5) of the abrasive article 12 that are not supported by the attaching elements 60 do not abrade at all or very little because of the space existing between them and the surface of the adapter body. The attaching elements 60 may be placed adjacent the periphery of the adapter body since most of the abrading operation takes place at the periphery. The attaching elements 60 are long enough to bridge or extend over hardwood and softwood sections of the wood flooring 16. The attaching elements 60 may be adhesively coupled to the surface and have their fastening elements, such as protrusions or hooks 62 adapted for engagement with complementary loop configurations on the abrasive disc 12. It will be appreciated that the abrasive article 12 can be repositioned on the attachment strips, whereby non-abraded portions 68 can then be repositioned over the elements 60 and subsequently abraded during another operation. The number of times the article 12 may be repositioned is determined by the area of the attaching elements 60 themselves and the degree of circumferential spacing between those peripherally spaced attaching elements 60. For example, if the spacing is such as to accommodate three abrading elements 60, then three indexing operations may be performed. Also, powdery particles and debris generated during sanding and which might otherwise accumulate on the abrasive disc surface to impede sanding is free to be displaced radially outwardly, thereby lessening a tendency to accumulate on the abrasive particles, whereby longer abrasive article life is promoted.

Figure 4:
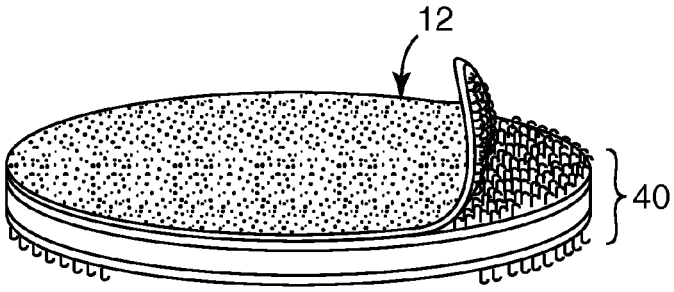
FIG. 4 is a schematic view of an abrasive article being peeled from the adapter apparatus of the present description.

As seen in FIG. 4, the relatively stiff adapter apparatus 40 facilitates a user being able to relatively easily separate or peel the flexible abrasive article 12 therefrom. As a result, a user may grasp a peripheral portion of the abrasive article and peel it from the surface of the adapter apparatus 40 without the abrasive article becoming more enmeshed, as would be the case when mated with another flexible component. The noted stiffness inhibits mating engaged hook and loop fasteners forming a tighter engagement therebetween as may be the case when two flexible substrates are peeled or delaminated with respect to each other. Stated differently, the stiff construction inhibits aggressive engagement between mating attachment mechanisms of the abrasive article 12 another flexible surface of a flexible type of conversion pad or other flexible surface. It will be appreciated that the degree of stiffness should be whatever is appropriate to effect an easy delaminating of the flexible modifying surface. Accordingly, at least only a portion of an edge region of the abrasive article may be grasped and the entire article peeled by a user thereby affecting easy delaminating of the surface modifying article.

As seen in FIG. 5, the adapter apparatus may act to displace the powdery particles and debris generated during surface modification, generally radially outwardly as the adapter apparatus is rotatably driven. The attaching elements 60 may, in essence, act as impeller type blades that facilitate radial transmission or displacement of the resulting particles and debris formed during surface modification. In this regard, as noted, the attaching articles 60 are angled to have an orientation relative to the rotational axis, whereby rotation in the direction of the arrow (see FIG. 3) will guide, plow or drive the particles and debris outwardly. The angled inclination of the attaching articles 60 may vary depending on the degree of radial transmission that is desired, as is known in this field to one or ordinary skill in the art. Also as is known, the rotational speed of the blades will determine the amount of debris that is radially dispersed under centrifugal forces. Accordingly, particle and debris build-up on the abrasive particle working surface which might otherwise diminish the latter's useful life is inhibited. To prevent the dispersed particles and debris from being deposited on the working surface being treated, a shroud 70, made any flexible material, may be connected to the base of the power tool. The shroud enhances the efficiency of dust control management. A suction or vacuum device 72 may be directly connected to the power tool or separate from the power tool. The vacuum device 72 acts to draw the powdery particles and debris radially away from the article 12. Accordingly, the attaching elements 60 which, in combination with the stiffening assembly of the adapter, not only provide for areas of greater unit pressure also act as impeller-like blades that act to control displacement of the powdery particles and debris.

The present disclosure may take on various modifications and alterations without departing from the spirit and scope. Accordingly, this disclosure is not limited to the above-described embodiments, but is to be controlled by limitations set forth in the following claims and any equivalents thereof.

What is claimed is:

1. An assembly suitable for modifying a surface, the assembly comprising:

an adapter assembly comprising:

a generally planar member defining a rotational axis and a driving surface having a periphery, and a plurality of attaching elements attached to portions of the driving surface of the generally planar member in spaced apart relationship to each other, each of the attaching elements including a plurality of fastening elements, wherein the spaced apart arrangement of the attaching elements provides discrete regions of the driving surface at which the fastening elements are not present; and an abrasive article attached to the attaching elements but not supported by the generally planar member.

2. The assembly of claim 1, wherein the attaching elements are attached adjacent the periphery of the generally planar member, and a peripheral gap exists between the generally planar member and the abrasive article, and the peripheral gap provides radial paths for powdery particles and debris to migrate radially outward while the adapter assembly is rotated about a rotational axis.

3. The assembly of claim 1, wherein the attaching elements have a generally elongated rectangular shape and are attached to the driving surface so that they are in circumferentially spaced apart relationship to each other and generally radially offset to the rotational axis.

4. The assembly of claim 3, wherein the attaching elements have the same width and long or short longitudinal axes, and all of the attaching elements extend to the driving surface such that the attaching elements having the long longitudinal axes alternate with the attaching elements having the short longitudinal axes.

5. The assembly of claim 1, wherein the abrasive article comprises first and second opposing major surfaces, the first major surface releasably engaged with the attaching elements, and the second major surface is adapted to modify a working surface.

6. The assembly of claim 1, wherein the first major surface of the abrasive article is releasably engaged with the attaching elements by complementary hook and loop fastener elements.

7. The assembly of claim 1, wherein the generally planar member comprises a core sandwiched between spaced apart planar members, the core comprising plastic, tempered hardwood, fiberglass or plywood, and the spaced apart planar members comprising melamine.

8. The assembly of claim 1, further comprising a conversion pad comprising a non-woven material and attached to the generally planar member on a side opposite the abrasive article.

9. The assembly of claim 8, wherein the generally planar member and the conversion pad are releasably engaged with complementary hook and loop fastener elements.

10. The assembly of claim 8, wherein the generally planar member and the conversion pad are releasably engaged with pressure sensitive adhesive.

11. An apparatus for controlling displacement of powdery particles and debris resulting from the modification of a working surface by a surface modifying article, the apparatus comprising:

a driving member having a driving surface rotatable about an axis of rotation;

a plurality of spaced apart elements attached to the driving surface at least adjacent its periphery; and a continuous surface modifying article covering the plurality of elements and spaced from the driving surface to define a peripheral gap for controlling movement of powdery particles and debris generally radially from the axis of rotation, wherein the attaching elements are spaced relative to each other and have an orientation relative to the axis of rotation such that in response to rotation being imparted to the driving member, displacement of the powdery particles and debris formed by the surface modifying article are radially dispersed.

12. An apparatus comprising:

a driving member having a driving surface rotatable about an axis;

a plurality of spaced apart segments attached to the driving surface adjacent to at least its periphery; and a surface modifying article having first and second opposing major surfaces, wherein the first major surface has at least one portion in releasable engagement with the segments and the second major surface is adapted to modify a working surface;

the segments form working areas of greater unit pressure on corresponding portions of the second major surface during surface modification by the surface modifying article, such that surface modification is performed primarily by the second major surface corresponding to the working areas than portions of the second major surface not corresponding with the working areas, and the releasable engagement enables those portions of the second major surface not corresponding to the working areas to be repositioned to be corresponding to the working areas so that subsequent surface modification is performed primarily by areas that did not perform surface modification.

13. The apparatus of claim 12, wherein the plurality of spaced apart segments and the at least one portion of the first major surface of the surface modifying article are releasably engaged with complementary hook and loop fastener elements.

* * * * *

UNITED STATES PATENT AND TRADEMARK OFFICE

CERTIFICATE OF CORRECTION

PATENT NO. : 8,790,164 B2
APPLICATION NO. : 13/277247
DATED : July 29, 2014
INVENTOR(S) : Allen Rivard It is certified that error appears in the above-identified patent and that said Letters Patent is hereby corrected as shown below:

In the Specification

Column 8

Lines 19-20, delete "INSTA-LOKT™" and insert -- INSTA-LOK™ --

Signed and Sealed this
Ninth Day of December, 2014

Michelle K. Lee

Michelle K. Lee
*Deputy Director of the United States Patent and Trademark Office*